United States Patent [19]

Casamayor

[11] 4,184,297

[45] Jan. 22, 1980

[54] EXTRUDED PLASTIC PANEL HOLDING AND JOINTING STRIPS AND WINDOW ASSEMBLIES THEREWITH

[75] Inventor: Jorge Casamayor, Columbus, Ohio

[73] Assignee: Plaskolite, Inc., Columbus, Ohio

[21] Appl. No.: 912,079

[22] Filed: Jun. 5, 1978

[51] Int. Cl.[2] ..... E06B 3/26; E04C 2/38

[52] U.S. Cl. ..... 52/202; 52/403; 52/716; 52/476; 52/780

[58] Field of Search ..... 52/202, 203, 476, 477, 52/716, 282, 582, 281, 772, 773, 780, 781, 777, 403; 403/391; 24/81 CC

[56] References Cited

U.S. PATENT DOCUMENTS

| | | | |
|---|---|---|---|
| 2,960,734 | 11/1960 | Collins | 52/202 |
| 3,939,620 | 2/1976 | Bero | 52/476 |
| 4,105,814 | 8/1978 | Eggert | 52/716 |

FOREIGN PATENT DOCUMENTS

| | | | |
|---|---|---|---|
| 831286 | 1/1968 | Canada | 52/403 |
| 2459017 | 6/1976 | Fed. Rep. of Germany | 52/202 |
| 1311988 | 11/1962 | France | 52/282 |
| 547467 | 8/1942 | United Kingdom | 52/780 |
| 817995 | 8/1959 | United Kingdom | 52/780 |

*Primary Examiner*—James L. Ridgill
*Attorney, Agent, or Firm*—Kenyon & Kenyon

[57] ABSTRACT

Improved panel holding and jointing strips and insulating window assemblies made therewith are disclosed. Hinged perimeter and jointer strips allow the use of insulating panels in large windows with multiple panes and commercial applications where strength and esthetic appeal are important considerations. The strips are also adapted to receive glazing or insulating panels of various thicknesses and are also useful in providing insulating windows for existing prime windows in an array.

26 Claims, 13 Drawing Figures

Fig. 7.
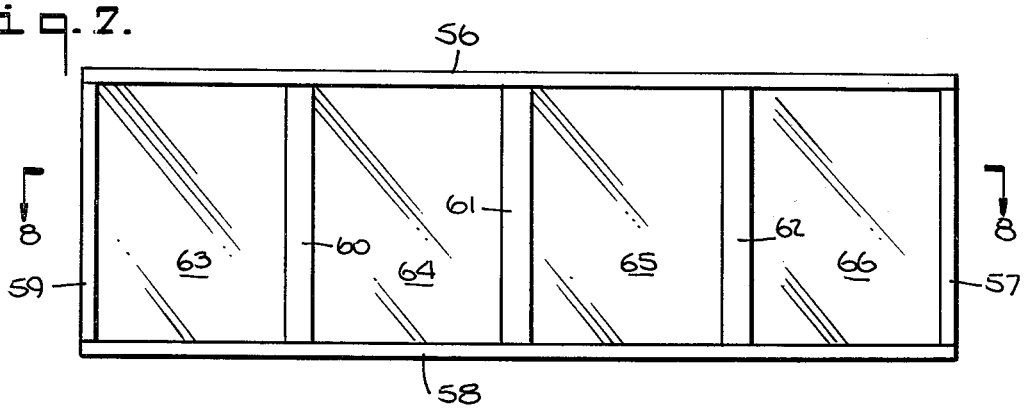
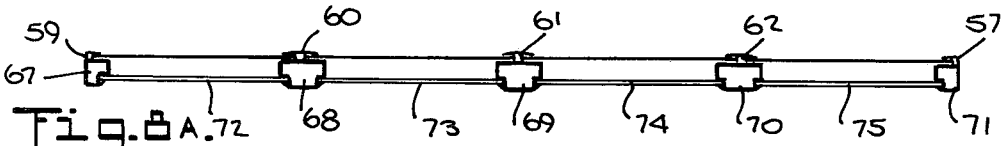
Fig. 8A.
Fig. 9.
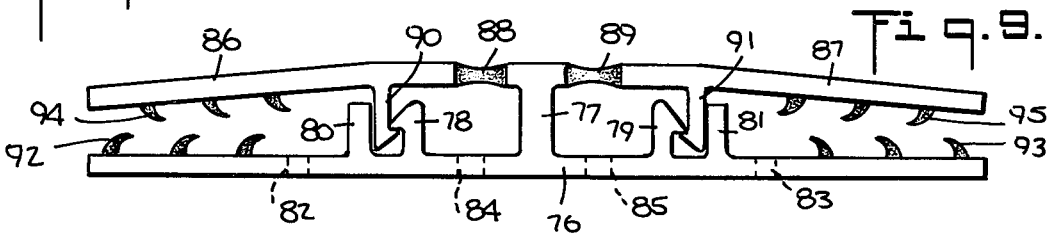
Fig. 10.
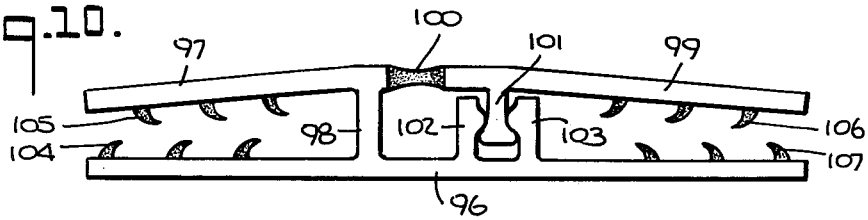
Fig. 3A.
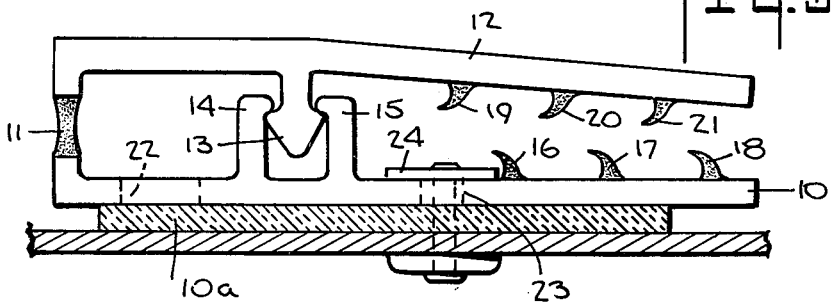
Fig. 4A.
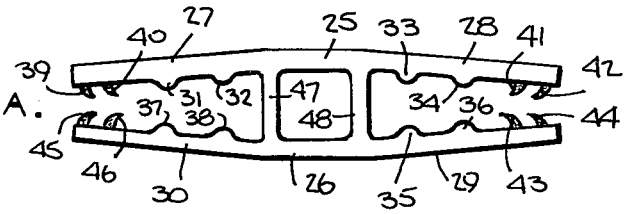

EXTRUDED PLASTIC PANEL HOLDING AND JOINTING STRIPS AND WINDOW ASSEMBLIES THEREWITH

BACKGROUND OF THE INVENTION AND DESCRIPTION OF THE PRIOR ART

This invention relates to extruded plastic framing and joining strips useful for holding glazing panes adjacent the frame of an existing prime window and insulating windows including glazing panes assembled with such strips.

In the prior art many types of panel holding strips have been proposed for use in the installation of insulating glazing at a prime window.

These have included strips described in U.S. Pat. Nos. 3,360,893 to Wattelez, 4,069,641 to DeZutter and 3,939,620 to Bero.

Such strips have consisted of elastic rubber mounts as described in U.S. Pat. No. 3,360,893, hinged one piece dual durometer strips as described in U.S. Pat. No. 3,939,620, and two piece interlocking strips as set forth in U.S. Pat. No. 4,069,641.

While such types of strips are useful, their utility is limited in some applications because the strips can hold glazing only of a predetermined thickness for an optimum seal or are otherwise limited in strength so that such strips are not useful for either expansive or heavy glazing panels. Further the utility of many such strips is limited because they are adapted for optimum use only around the perimeter of a single window. Thus, where an array of separate adjacent windows is in a building, as in many commercial and office buildings, a single perimeter strip around each element of the array to hold an insulating pane in correspondence with the window is often impractical. The vertical prime window frame element separating adjacent windows in an array is usually too narrow to hold two adjacent framing strips. Furthermore, even if the vertical prime window frame were wide enough for two single framing elements, additional effort is required to install two strips and the total effect of such an installation may not be esthetically pleasing. In addition, the intrinsic design of such strips renders them unsuitable for coloring or decorative laminating; hence, such strips when installed may not be attractive, or must be painted to match environmental decor.

Further, the manner of installation of such strips may also be limited by a predetermined design, such as headed fasteners in the case of U.S. Pat. No. 3,360,893 or adhesive as in U.S. Pat. No. 4,069,691.

SUMMARY OF THE INVENTION

In my invention, I have provided practical and improved extruded plastic panel framing, holding and joining strips suitable for use with glazing panels of various thickness and adaptable to many different types of existing prime windows. The strips are strong, durable and easily adapted to receive decorative lamination or coloring during manufacture. The strip is also suitable for use as a mounting for exterior, as well as interior, window application, and is strong enough to receive conventional glass, as well as plastic, glazing panels.

In my invention extruded lengths of rigid material are joined by an intrinsic hinge element and a communicating set of releasably interlocking legs or ribs. The rigid elements form a channel which receives the edges of the glazing material to be held; and the inner surfaces of the channel include protruding gasket ribs which adapt the channel to receive glazing panes of a range of thicknesses and hold and provide an air seal for the pane.

As well as being useful for interior and exterior use, the strips may be installed to the casing of a prime window with a variety of means and may also be adapted to be installed on the interior casing of a window as well as around the frame or other plane surface surrounding a prime window. Thus, my invention provides a universal strip for window mounting.

More particularly, the invention is described by reference to the drawings and following description of the preferred embodiment.

BRIEF DESCRIPTION OF THE DRAWINGS

FIG. 3 is a perspective view of a section of the perimeter holding strip and FIG. 3A is a cross-section view of the same strip.

FIG. 4 is a perspective view of a jointer strip used in connection with windows using multiple panes to cover a relatively wide expanse and FIG. 4A is a cross section view of the same strip.

FIG. 7 depicts framing and joining strips of the invention employed with an array of adjacent windows to hold glazing panes for insulation or solar control.

FIG. 8 and FIG. 8A are a horizontal cross sections of the window of FIG. 7 thru line 8—8.

FIG. 9 is a cross sectional view of the jointer strip of the invention useful for an array of panels as in the installation of FIG. 7.

FIG. 10 is an alternate embodiment of the strip of FIG. 9.

DESCRIPTION OF THE PREFERRED EMBODIMENT

Figure 1:
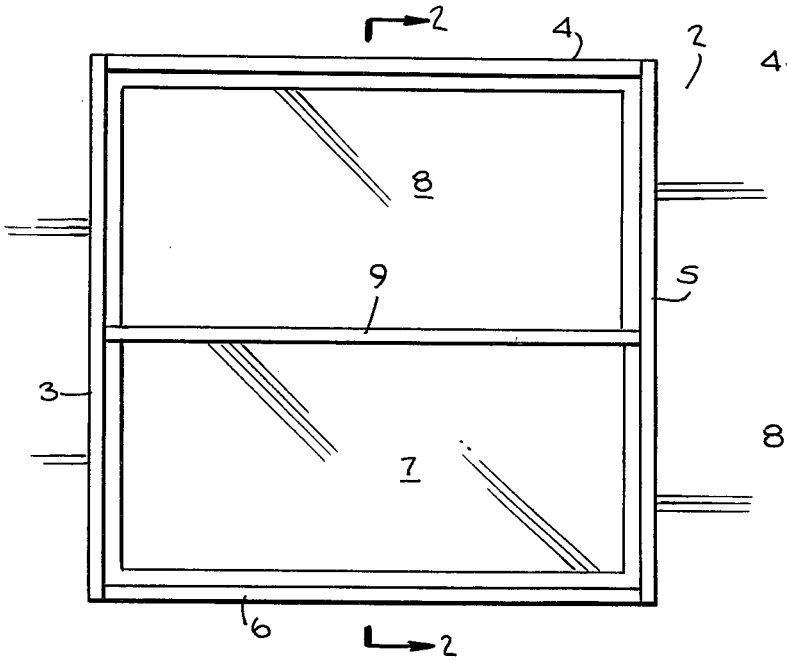
FIG. 1 depicts an installed double panel window using the perimeter panel holding strip and jointer strips of the invention.

Preferably, the pane holding and joining strips of the invention consist of a one piece extrusion of dual durometer plastic, perferably polyvinyl chloride. A rigid vinyl and a soft, flexible vinyl are coextruded to fabricate the strip.

As is known in the co-extrusion art, in making the strip, the rigid and flexible vinyl are fed into separate intake manifolds of an extruder and are simultaneously extruded thru the same die at portions of the die corresponding to the predetermined portions of the dual durometer strip utilizing each type of plastic. The extrusion of such strips and selection of suitable plastics for use in accordance with the preferred embodiment are carried on in accordance with methods known in the art depending on design parameters and intended environmental conditions of use for particular applications.

The invention generally consists of substantially improved perimeter strips and jointer strips for the installation of insulating glazing panes or solar control panels in conjunction with an existing prime window. In its preferred embodiment, the perimeter and jointer strips of the invention will be employed with a heavy guage panel, such as 0.125" glazing, to cover a large area, such as that typically found in windows in modern office buildings, and other commercial facilities. A further preferred example of the invention is in conjunction with windows in such types of buildings in which separate windows are side by side separated only by narrow framing members in an array extending along the width of a building. For such applications, prior art strips have not been practical and typically insulating or solar control have not been utilized in such buildings, resulting in excess energy consumption and a failure to realize the advantages of insulation.

Furthermore, the unique features of the strips of the invention permit the use of glazing in a range of thicknesses. This minimizes inventory requirements for different types of strips and further allows use of a particular gauge of glazing which is the optimum thickness for a particularly sized window.

A further improved feature of the perimeter an jointer strips of the invention is that in the case of such strips which are hinged, the location and extent of the hinge with respect to interlocking members works accurately to align the means for interlocking on the respective members. Locking and releasing are facilitated by accurate positioning of the channel forming members, in comparison with the relatively flimsy orientation of such members in prior art strips resulting from a relatively expansive hinge member in the prior art strips. An improvement over other commercially available panel holding strips thus results from the present invention which facilitates use of the strips described herein with expansive and large windows.

This improved alignment results from the proximity of the hinge portion of the member to a relatively squared rigid element. For example, in the perimeter strip, the hinge is located centrally extending in the back about $\frac{1}{3}$ the height of the back and intrinsically extruded with the perpendicularly extending elements of the rigid interlocking members. In the hinged jointer strips, the hinge extends from the bar of a "T" shaped member. Thus, it can be seen that the hinge extending from a corner is reinforced by the corner itself, providing added strength. The further relatively narrow expanse of the hinge portion also reduces opportunity for misalignment of the members.

Another advantage of the present invention is that the squared, rigid strips with flat elements thereof may be easily printed, laminated or hot stamped with a finish that simulates wood grain, brushed aluminum, or other metalized finish such as copper, etc. where such decoration has been impractical with prior art strips. This improvement provides enhanced utility of the strips of the invention in applications such as in office buildings, cafeterias, or other commercial or institutional locations at which it is desired to install an interior insulating window and considerations of esthetics are important.

Typically, the window installed in accordance with the invention is an interior window panel used for insulation or solar control purposes. The window panel may be transparent glazing or a colored or dyed panel for solar control.

The window panel is held to the frame of an existing prime window with strips around the perimeter of the prime window frame and the elements of the window panel are joined by separate jointer strips. Thus, an interior window of the invention would typically include perimeter framing strips holding a plurality of glazing panes which are joined by separate jointer strips.

Figure 2:
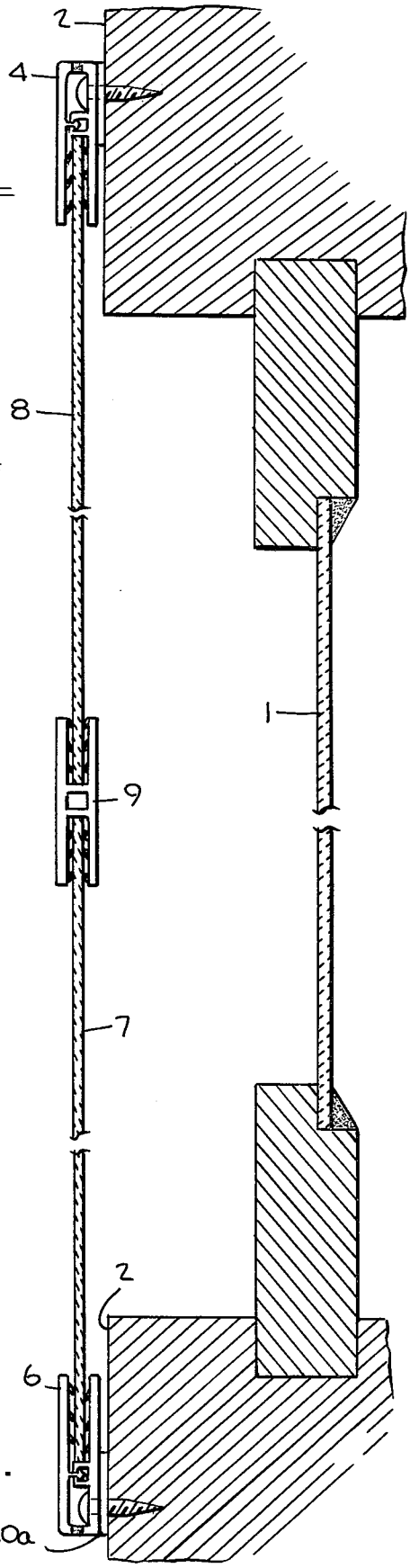
FIG. 2 is a vertical cross section of an installed window with horizontal jointer strip depicted in FIG. 1 thru line 2—2.

An example of an interior insulating window in accordance with the invention is depicted in FIG. 1. An existing prime window, 1, is surrounded at its interior facing side by a plane surface 2 which may be either the window frame or wall around the window. Perimeter framing strips 3, 4, 5 and 6 in accord with the invention are applied to the plane surface surrounding the window perimeter. The perimeter strips hold separate glazing panes 7 and 8 which are joined by jointer strip of the invention 9. A vertical cross section is depicted in FIG. 2 in which the reference numerals correspond to the identical elements first identified by the same numerals in FIG. 1. It can be seen that an insulating air space is created between prime window 1 and panels 7 and 8. The casement is further sealed by the perimeter strip 3, 4, 5 and 6.

Figure 3:
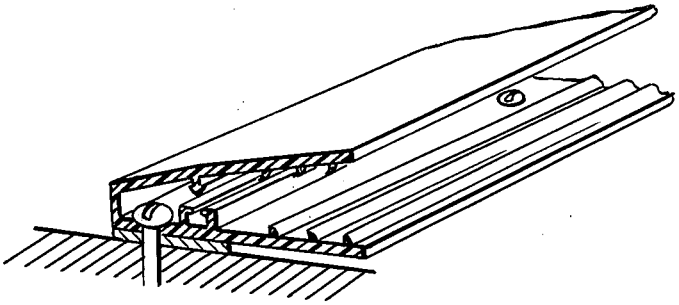

The perimeter strips 3, 4, 5 and 6, depicted in perspective in FIG. 3 and in extrusion profile in FIG. 3A are one piece extruded dual durometer vinyl strips. The perimeter strips include a rigid substantially flat base element, 10, which is applied adjacent the plane surface surrounding the window opening. From a perpendicular extension forming a corner at one side of the base is a co-extruded flexible vinyl hinge element 11 intrinsically connecting to a corresponding perpendicular extrusion from upper element 12. The hinged base element and upper element are releasably interlockable by integral means for interlocking such as the barb 13 extending from element 12, interlocking with footed legs, 14 and 15 extending from base member 10. In a normal interlocked position, the surface of the width of upper member 12 tapers inwardly towards the base member beginning from the barb extending to the end of the element. The portion of element 12 extending from the hinged portion to the barb is normally parallel with base member 10.

A channel to receive the edge of a glazing pane is defined by the inner surface of elements 10, 15 and 12. Extending from the inner surfaces of elements 10 and 12 on the inner surface of the channel formed are intrinsic gasket feathers of co-extruded flexible vinyl. Such gaskets are indicated by 16, 17 and 18 extending from base member 10 and 19, 20, and 21 extending from outer member 12.

Thus a one-piece, dual durometer, releaseably interlockable, gasketed channel, extruded perimeter strip is provided.

In the dual durometer extrusion, the rigid plastic forms base member 10 intrinsically with its extending footed legs 14 and 15 and upper member 12 intrinsically with barb 13. The base and upper members are hingingly united by the coextruded hinge element 11 of flexible vinyl. Gasket feathers 19, 20 and 21 extending from the inner surface of elements 12 and feathers 16, 17 and 18 extending from elements 10 are similarly intrinsically coextruded. The perimeter strip may be applied to the plane surface 2, by conventional means such as double faced adhesive tape, screws, nails and the like. However, because the strip is intended for commercial use, it may likely be applied to metal prime window frames. Hence, it may thus be riveted to such frames and an alternating series of slots or holes to receive a rivet may be provided. Such slots are preferably centrally located in base member 10 between the hinged back 11 and footed leg, 14, as indicated at 22 and in the space between footed leg 15 and gasket 16, as indicated at 23 at regular or alternating intervals. A collapseable rivet attaching the strip to prime window frame, 2, is indicated by 24. Preferably, a sealant to provide an optimum air seal for insulating purposes is applied between the outer surface of the base member 10 and plane surface 2.

Figure 5:
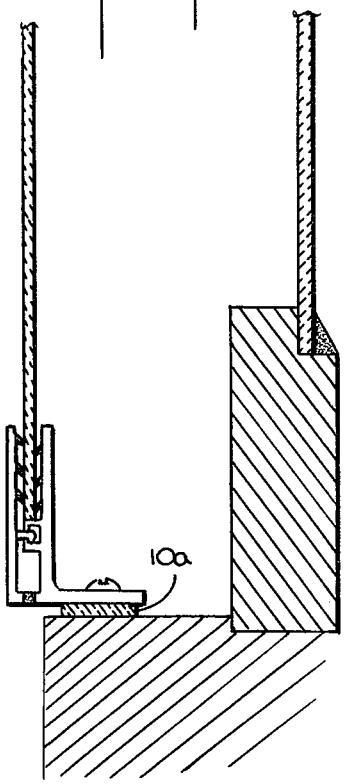
FIG. 5 is a profile of a strip utilizing the features of the invention in an alternate embodiment adapted for installation on the interior casing of a window.

An alternative embodiment of the perimeter strip allows installation of an insulating window from the inside of a window frame as is depicted in FIG. 5. In this embodiment, a third rigid member perpendicularly extends from the base member of the strip oppositely extending from the hinge portion to allow fastening to the inside of an existing prime window frame. This third member may be intrinsically extruded with the strip or may be a separate right angle member. The base of the strip is taped or otherwise affixed to one leg of the right angle member leaving the remaining leg free to be mounted on the inside of the window frame as depicted in the drawing.

Figure 4:
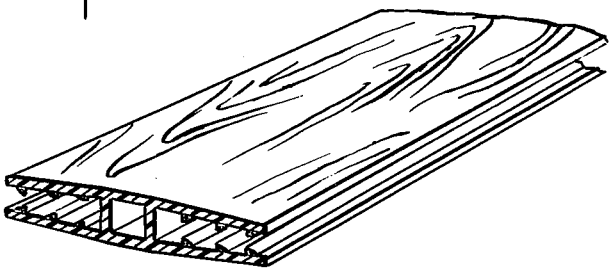

The perimeter strips thus surround the prime window opening and hold and seal the edges of the glazing panes. In an insulating window for a large opening, it may be necessary to employ more than one pane as is depicted in FIG. 1. In such event, a jointer strip, 9, is employed to unite the panes to an aggregate size sufficient for the opening. Such a jointer strip of the invention is depicted in FIG. 4 in perspective and in extrusion profile cross-section in FIG. 4A.

The jointer strip is co-extruded dual durometer plastic member having a generally "H" shape. With reference to FIG. 4A in profile, extending from a hollowed central ox portion with outer surfaces 25 and 26 are inwardly tapering legs 27, 28 29 and 30 which define two oppositely facing open channels which receive the edges of separate adjacent glazing panes which are to be united. The inner surfaces of the legs forming the channel include half-rounded protrusions, indicated by 31 and 32 on leg 27, 33 and 34 on leg 28, 35 and 36 on leg 29, and 37 and 38 on leg 30. At the ends of the inner surfaces of the channel forming legs adjacent the opening, each leg is provided with co-extended gasket sealing feathers of a softer flexible vinyl plastic. On leg 27, these feathers are indicated at 39 and 40; on leg 28 at 41 and 42, on leg 29 and 43 and 44; and on leg 30 at 45 and 46.

Connecting legs 47 and 48 form the remaining sides of the connecting bar forming the "H" shaped cross section. The central box feature of the jointer strip provides a high degree of stiffness and strength to the strip. In combination with the tapering legs, the half round protrusion and flexible gasket sealing feathers allow easy insertion and release of the edge of a glazing panel, but securely maintain the edges therein. Further the stiffness of the shape and taper of the channel walls which flex, allow the jointer strip to be used with varying gauges of thickness of glazing panels.

Figure 6:
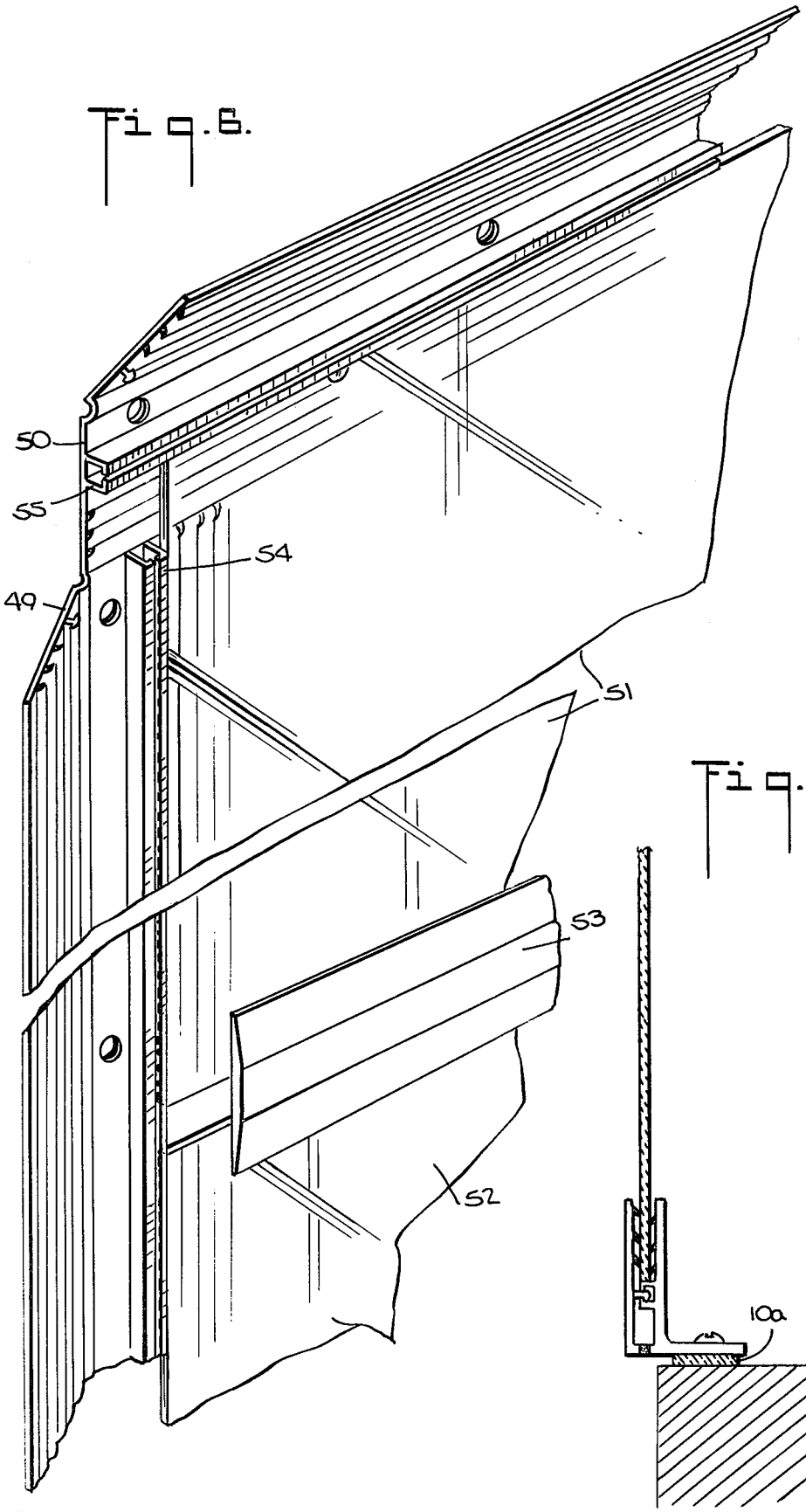
FIG. 6 depicts the self alignment feature of pane and strip allowed by the invention.

FIG. 6 depicts several features of the perimeter and framing strips of the invention as applied to the perimeter of an opening in which the perimeter strips are shown in an open position. In the Figure, perimeter strips 49 and 50 meet in a butt joint at a corner of the opening. Separate glazing panes 51 and 52 joined by jointer strip 53 cover the area defined by the perimeter circumscribed by the inner footed legs of the perimeter strips, indicated by 54 on strip 49 and 55 on strip 50. In FIG. 6, it can be seen that the jointer strip 53 does not extend the entire width of the panes, but rather, on each edge is diminished in length to allow the edges of the pane to extend into the channel to be formed by the perimeter strips. Once the panes are so aligned with respect to the perimeter strips, the outer members are interlocked and the window is thus provided.

FIG. 7 depicts the strips of the invention used in connection with insulating or solar control panels in a segmented array corresponding to separate adjacent prime windows such as those found in many office buildings. An insulating air space and seal of the prime window is effected.

Around the large perimeter of the opening defined by the array of windows are applied perimeter strips, of the invention, as depicted in FIGS. 3 and 3A and described above, indicated by 56, 57, 58 and 59. Jointer strips 60, 61, and 62 correspond to the separate frames of the window of the array and panes 63, 64, 65 and 66 correspond to the segmented separate windows of the array.

Figure 8:
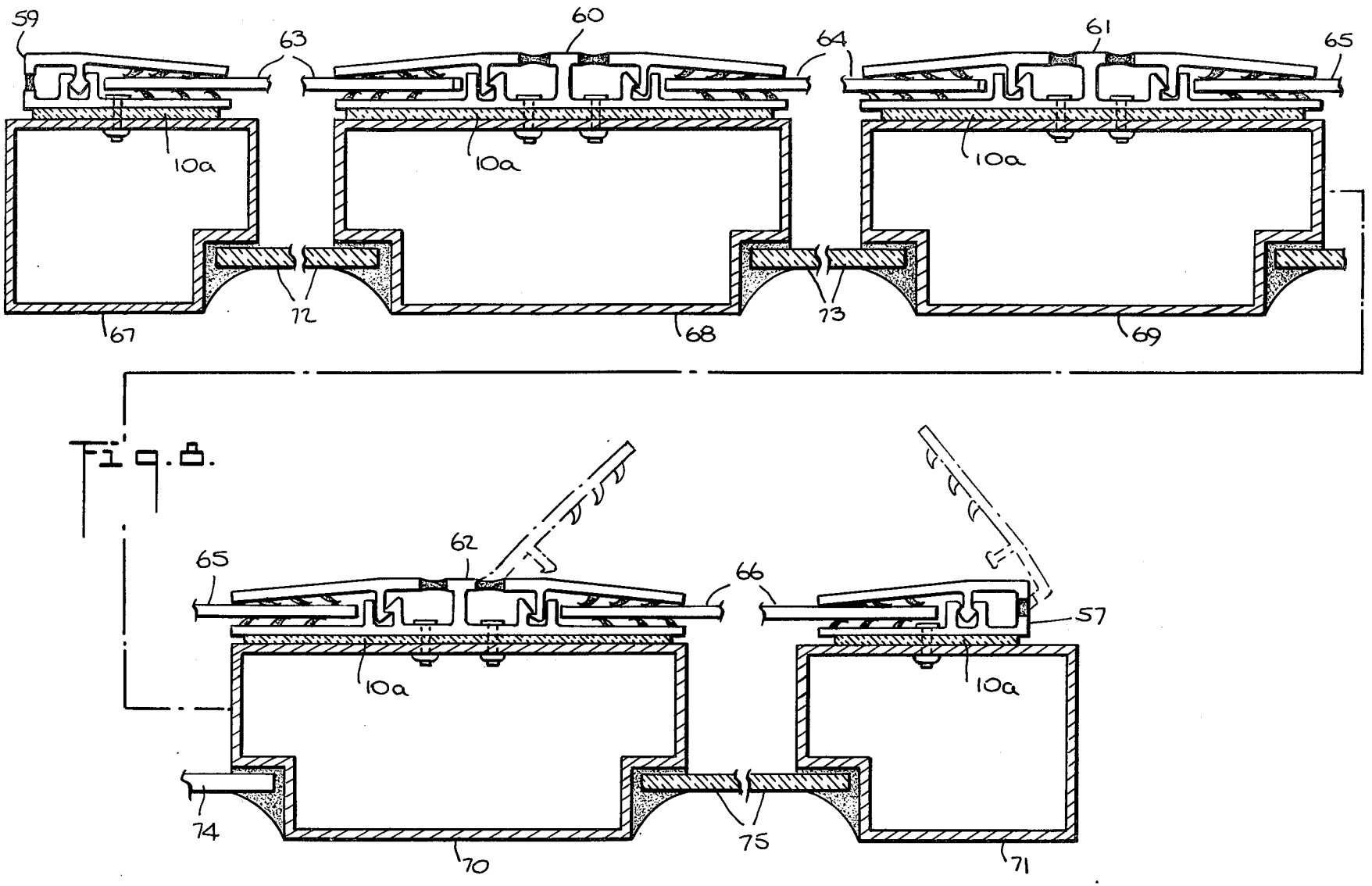

FIG. 8 is a cross section of the installation of FIG. 7 through horizontal line 8—8 in FIG. 7. Hence, more clearly depicted are the vertical framing numbers 67, 68, 69, 70, and 71 of the separate arrayed prime windows 72, 73, 74 and 75 and the correspondence of the location and size of the prime windows with the insulating windows is more readily apparent.

The jointer strips 60, 61 and 62 may be the strips such as previously described and depicted in FIG. 4A or in accordance with FIG. 9 and FIG. 10 as discussed below. Because however an expansive area is covered by large panels, the jointer strips are attached to the frame members of the prime windows for added strength and reinforcement. This may be done by a screw through the central box of the strip though the sides 25 and 26 if a jointer strip such as depicted in FIG. 4A is used. In this manner, the insulating window is removeable by releasing the interlock of the perimeter elements and unscrewing the jointer strips from the vertical framing members of the prime window.

Preferably, however, a jointer strip in such an arrayed installation will allow each panel in the array to be considered a separate element independent of the other panels in the array. This is accomplished by providing a hinged releaseably interlocking jointer strip as is depicted in alternate embodiments in FIG. 9 and FIG. 10.

FIG. 9 depicts an extrusion profile of a double hinged jointer strip for joining adjacent panes in an array. Such a strip is an integral hinged dual durometer panel holding jointer strip with oppositely facing panel holding channels having releaseable channel forming members hinged to a common back.

The strip includes a flat base member 76 having the common "T" shaped back, 77, intrinsically extending therefrom. The strip forms symmetrical oppositely facing channels. Hence, means for interlocking 78 and 79 are on each side as well as perpendicular ribs 80 and 81 which protect the interlocking means from interference by the glazing pane. A series of holes to receive rivets, screws, nails or othr fasteners indicated at 82 and 83 and 84 and 85 may be alternately included in the base of the strip at regular intervals to allow the strip to be fastened to the framing member of the prime window.

The releaseably interlockable upper channel forming members 86 and 87 extend from each side of the "T" shaped common back, thru co-extruded flexible, integral hinge members 88 and 89. Interlocking means with the base is provided by communicating semibarbed interlocking members 90 and 91 extending from the upper member. Co-extruded integral gasket sealing feathers are provided on the inside surfaces of the channels formed such as indicated by 92, 93, 94 and 95. There is thus provided a hinged jointer strip with releasable oppositely facing hinged channels to join adjacent panes. It will be apparent that in the co-extrusion of such member from a rigid and flexible vinyl, the rigid vinyl will be used to form the base member, "T" back, protective rib and interlocking means and the hinged upper channel forming member and its integral means for interlocking with the base. A soft flexible vinyl will be used to form intrinsic the hinge elements and the gasket seals.

A significant advantage achieved by the communicating semibarbed interlocking means of members 90 and 78 and 91 and 79 of the strip of FIG. 9 is a reduction in the total width required by the strip for an interlock of a given strength. Thus it is apparent that the interlock of the strip of FIG. 9 requires about 30% less space in width then the interlocking means of FIG. 3A. This allows a narrower more esthetically pleasing jointer strip to be provided in a size not disproportionate to the perimeter strips. When such a jointer strip is employed in an arrayed window as in the jointer strips 60, 61, and 62 in the assembly of FIG. 7, it can be seen that the symmetrically opposite separate channels allow each glazing pane in the array to be separately considered from the adjacent pane and independently placeable into and removeable from the array. This is depicted in FIG. 8 in which the dotted lines of members 62 and 57 depict the hinges of the members in an open position.

A further alternative jointer strip is depicted in FIG. 10, in which it can be seen that only one channel of the pair of oppositely facing channel is releaseably interlockable. One channel formed between the flat base 96 and first outer element 97 is a rigid permanently formed channel in which the base and outer element are connected by intrinsic back member 98.

The opposite channel is a hinged releaseably interlockable channel formed by second outer element 99; hinged by flexible hinge element 100 to the opposite permanent channel element 99, and intrinsically therewith connected to base member 96 thru back, 98. Means for releaseably interlocking the upper member with the base member are provided by the beaded rib 101 extending from element 99 interlocking with the pair of shouldered ribs 102 and 103 formed in the base member. Co-extruded flexible gasket sealing feathers may also be included on the inner surface of the two channels formed as indicated at 104, 105, 106 and 107. When such a jointer strip is used in an assembled array, it is readily apparent that each pane in the array is held on at least one vertical side by a releaseably interlocking strip whereby the pane is independently removeable. The dual durometer extrusion of this strip includes rigid vinyl channel forming members 96, 97 and 99, rigid connecting and interlocking means 98, 102 and 103, and 101 and flexible vinyl hinge 100 and the feathered gaskets, 104, 105, 106, and 107.

The preferred embodiment of the hinged, releaseably interlockable strips of the invention, intended for commercial use in conjunction with existing metal prime window frames, will be attached with rivets, screws and/or other fasteners, such as double face insulating adhesive tape depicted at 10*a* in FIGS. 2, 3A, 5 and 8. Preferably, holes for receiving fasteners are located on alternate sides of the means for interlocking of the member intended to be adjacent the prime window frame.

In this manner, fasteners secure the framing strip on both sides of the interlocking member where it is expected that the most stress is applied to the strip in releasing the interlock to open the strip. In the drawings such holes are depicted in FIGS. 3A at 22 and 23 and in FIG. 9 at 82 and 83 as examples of such alternate fastening.

While in the preferred embodiment, a co-extruded polyvinyl dual durometer plastic is used to produce the members described, substitutions are possible. For example, hi-density polyethylene or polypropylene, both materials having good hinge qualities may be used as the plastic forming the hinged rigid members of the strips. Foamed insulating tape or other equivalents may be substituted for the gasket sealing feathers in other embodiments.

When the strips are used in combination with an existing prime window having a sill, a conventional sill strip such as employed in U.S. Pat. Nos. 3,939,620 or 4,069,641 is used at the bottom of the particular window installation.

Thus, in accordance with the window there is provided an improved pane framing strip having greater strength and versatility than conventional strips. While dimensions of the strips may be variable, representative strips which are capable of use with glazing from 0.080 to 0.125 inch thickness may be extruded as followes in a dual durometer rigid and flexible polyvinyl chloride plastic:

EXAMPLE I

Perimeter Strip (FIG. 3A):
- Nominal thickness of rigid base and outer members and interlocking ribs: 0.050"
- Length of flexible hinge portion at back: 0.090"
- Angular inclination from parallel of tapering hinged outer member: 4°45'
- Height from bottom of base to top of outer portion: 0.270"
- Overall width of strip: 1.125"
- Depth of Channel: 0.70"
- Depth of flexible gasket sealing feathers within channel sides: 0.060"

EXAMPLE II

Jointer strip (FIG. 4A):
- Nominal thickness of rigid members: 0.045"
- Height of strip at center box: 0.270"
- Angular inclination from parallel of tapering outer elements: 4°45'
- Overall width of strip: 1.250"
- Depth of each channel: 0.480"
- Radius of rigid semi-round protrusions: 0.035"
- Depth of flexible gasket sealing feathers within channel: 0.060"

EXAMPLE III

Double hinged jointer strip (FIG. 9):
- Depth of each channel: 0.480"
- Overall width of strip: 1.5"
- (Other dimensions are the same as Example I for corresponding elements).

EXAMPLE IV

Single hinged jointer strip (FIG. 10):
- (Same dimensions as Example I for hinged side and same dimensions as Example II for permanent channel side).

While the foregoing are the preferred representative dimensions of strips suitable for use with light (0.080 to 0.125 inch) glazing, it will be apparent that the advantages of the invention may be secured with appropriately "scaled up" members suitable for use with heavier gauge glazing panels, such as 0.25 inch. For such use, it is apparent that the thickness of the rigid members and elements thereof would be increased for the additional strength required for such heavier glazing.

In the foregoing, I have described the preferred embodiment of my invention. It is apparent to those skilled in the art that variations of the elements described may be made without departing from the spirit of what I claim, which is the following.

What I claim is:

1. A one piece extruded plastic panel holding strip adapted to join adjacent panels in an array by receiving the side edges of adjacent panels in separate oppositely facing channels in the strip, said strip consisting of:

(A) a base member, (1) the base member having a rigid "T" shaped member extending from the central portion thereof and essentially dividing the base member into oppositely facing portions;

(2) the base member further including, in each divided portion of the base member, integral longitudinally extending means for releaseably interlocking with an upper member, (B) two hinge elements, said hinge elements integrally extending from each side of the integral bar crossing the "T" shaped member, the hinge element on each side of the "T" being integrally connecting to an upper member, (C) two substantially flat rigid upper members, one member extending from each hinge on each side of the "T", and each upper member frther including integral means for releaseably interlocking with the base member, said means of the upper member communicable with the means for releaseably interlocking of the base member, each upper member substantially extending in width from the hinge element to the location of the outer edge of the base member opposite the base of the "T", whereby, when each upper member is interlocked with the base member, two oppositely facing channels adapted to receive the edges of adjacent panels are formed between the upper members and the base member in the portions of said members between the interlocked means for interlocking and the extending widths of the members.

2. A one piece extruded plastic panel holding strip adapted to join adjacent panels in an array by receiving the side edges of adjacent panels in separate oppositely facing channels in the strip, said strip consisting of:

(A) a base member:

(1) the base member having a rigid "T" shaped member extending from the central portion thereof and essentially dividing the base member into oppositely facing portions;

(2) the base member further including, in one divided portion of the base member, integral longitudinally extending means for releaseably interlocking with an upper member, (B) a hinge element, said hinge element integrally extending from one side of the integral bar crossing the "T" shaped member, the hinge element being integrally connecting to an upper member, (C) two substantially flat rigid upper members, (1) the first upper member extending from the hinge extending from one side of the "T", and further including integral means for releaseably interlocking with the base member said means of the upper member communicable with the means for releaseably interlocking of the base member, (2) the second upper member integrally and rigidly extending from the opposite side of the "T" bar, (3) each upper member substantially extending in width to the respective side edges of the flat base member.

3. In extruded plastic panel holding strips adapted to be attached to the plane surface of the perimeter surrounding a wall opening, said strips having a base member and a releaseably interlockable upper member, the improved one piece extruded plastic hinged panel holding strip having a rigid reinforcing back extending from each of the base and upper members and having an intrinsic hinge between said extending back portions connecting said base and upper members and consisting of:

(A) a flat rigid base member adapted to be attached adjacent and to the perimeter of the pane surface surrounding the opening, said flat rigid base member including:

(1) a rigid perpendicularly extending reinforcing back disposed from one side of the width of the base member to form a rigid reinforcing corner therewith; and (2) means for releaseably interlocking with an upper member, said means for releaseably interlocking with an upper member intrinsically extending from the base member in the same direction as the back longitudinally in the portion of the width of the base member between the inside of the corner formed by the back and the base member and the opposite edge of the width of the base member;

(B) a hinge element, said hinge element being intrinsically extruded with the back extending from the base member, said hinge element, hingingly connecting the rigid back of the base member to the rigid back of a releaseably interlockable rigid upper member to which said hinge element is also intrinsically extruded; and (C) a rigid upper member, the upper member being substantially co-extensive in width with the base member and including:

(1) a rigid perpendicularly extending reinforcing back disposed from one side of the width of the upper member to form a rigid reinforcing corner therewith, said back portion intrinsically connecting to the hinge element; and (2) means for releaseably interlocking with the base member, said means for releaseably interlocking intrinsically extending from the upper member in the same direction as the back of the upper member, and longitudinally extending in the portion of the width of the upper member between the inside of the corner formed with the back and the opposite edge of the width of the upper member;

whereby, when the upper member is interlocked with the base member, a channel adapted to receive the edge of a panel is formed between the upper member and the base member in the portion of said members between the interlocked means for interlocking and the extending widths of the members.

4. The panel holding strip of claim 1 or 2 or 3 consisting of an extruded dual durometer plastic in which the hinge element joining the releaseably interlockable rigid members consists of a co-extruded plastic of softer durometer than the durometer of the plastic of the rigid member.

5. The panel holding strip of claim 1 or 2 or 3 in which at least one of the base and upper rigid members includes means for providing a gasket seal with respect to a pane at the inside surface of the member forming the channel.

6. The panel holding strip of claim 1 or 2 or 3 consisting of one of high density polyethylene, polypropylene and polyvinyl chloride.

7. The panel holding strip of claim 1 or 2 or 3 of a coextruded dual durometer polyvinyl chloride including:

a hinge element joining the rigid releaseably interlockable members, said hinge element consisting of a flexible polyvinyl chloride plastic softer than the polyvinyl chloride forming the rigid members, and means for providing a gasket seal for a pane, said means including a longitudinally coextensive intrinsic protrusion of a soft polyvinyl chloride extending from at least one of the inner surfaces of the rigid members forming the channel.

8. The panel holding strip of claim 1 or 2 or 3 including a decorative surface finish thereon.

9. A panel holding strip in accordance with claim 1 or 2 or 3 adapted to hold panels of a predetermined range of thicknesses in which each rigid upper member angularly extends towards the base member in the portion at least along its width extending in the channel forming portion thereof to provide a channel which interiorally increases in thickness from its open edge to its termination and in which the thickness of the channel at its open edge thereof corresponds approximately to the thinnest panel within the range and the thickness of the channel at its termination corresponds approximately to the thickest panel within the range.

10. The panel holding strip of claim 1 or 2 or 3 further including means for fastening said strip to a plane surface.

11. The panel holding strip of claim 10 in which the means for fastening includes a series of holes in the base member thereof to receive fasteners which affix said strip to a plane surface.

12. The panel holding strips of claim 1 or 2 or 3 consisting of an extruded dual durometer plastic and including means for providing a gasket seal with respect to a pane, which gasket sealing means include at least one set of co-extruded extending protrusions of softer durometer plastic than the durometer of the extruded rigid plastic, the co-extruded extending protrusions being longitudinally coextensive with the lengths of the rigid linearly extending elements, said protrusions extending along the surface of each rigid element forming the inner surface of the channel.

13. The panel holding strip of claim 12 in which the co-extruded set of extending protrusions consists of a feathered co-extrusion in the rigid elements.

14. A one piece extruded plastic panel holding strip adapted to join adjacent panels in a window array by receiving the side edges of adjacent glazing panels in separate oppositely facing channels in the strip, the strip consisting of the integrally extruded elements:

a relatively rectangular rigid hollow core member, four rigid channel forming members, being two oppositely facing channel forming members extending from each side of two opposite outer surfaces of the hollow core member the channel forming members extending from the core member being angularly directed inwardly to the center between arbitrary parallel extending lines which are tangent to the outer opposite surfaces of the core member from which the channel forming members extend, each channel forming member further including on the inward facing surface thereof:

at least one semi-rounded protrusion longitudinally extending adjacent the core member; and means for providing a gasket air seal with respect to a pane.

15. The panel holding strip of claim 14 consisting of a co-extruded dual durometer plastic and in which the means for providing a gasket air seal include a longitudinally extensive intrinsic co-extrusion of a plastic of softer durometer than the rigid elements of the strip.

16. The panel holding strip of claim 15 consisting of polyvinyl chloride.

17. An insulating window for a large existing prime window including:

(A) a hinged perimeter panel holding strip, said panel holding strip being adapted to be attached to a plane surface surrounding the perimeter of the existing prime window, and further being adapted to hold an independently removeable glazing pane in a channel therein, and said perimeter strip having a rigid reinforcing back extending from each of the base and upper members and having an intrinsic hinge between said extending back portions connecting said base and upper members and further consisting of:

(1) a flat rigid base member adapted to be attached adjacent and to the perimeter of the plane surface surrounding the opening, said flat rigid base member including:

(a) a rigid perpendicularly extending reinforcing back disposed from one side of the width of the base member to form a rigid reinforcing corner therewith; and (b) means for releaseably interlocking with an upper member, said means for releaseably interlocking with an upper member intrinsically extending from the base member in the same direction as the back longitudinally in the portion of the width of the base member between the inside of the corner formed by the back and the base member and the opposite edge of the width of the base member;

(2) a hinge element, said hinge element being intrinsically extruded with the back extending from the base member, said hinge element, hingingly connecting the rigid back of the base member to the rigid back of a releaseably interlockable rigid upper member to which said hinge element is also intrinsically extruded; and (3) a rigid upper member, the upper member being substantially co-extensive in width with the base member and including:

(a) a rigid perpendicularly extending reinforcing back disposed from one side of the width of the upper member to form a rigid reinforcing corner therewith, said back portion intrinsically connecting to the hinge element; and (b) means for releaseably interlocking with the base member, said means for releaseably interlocking intrinsically extending from the upper member in the same direction as the back of the upper member, and longitudinally extending in the portion of the width of the upper member between the inside of the corner formed with the back and the opposite edge of the width of the upper member;

and in which at least one of the base and upper rigid members includes means for providing a gasket seal with respect to a pane at the inside surface of the member forming the channel, whereby, wen the upper member is interlocked with the base member, a gasket sealed channel adapted to receive the edge of a glazing pane is formed between the upper member and the base member in the portion of said members between the interlocked means for interlocking and the extending widths of the members; and (B) at least one independently removeable glazing panel held at an edge thereof, adjacent the plane surface surrounding the perimeter of the prime window, in the channel of the said perimeter panel holding strip.

18. The insulating window of claim 17 in which the jointer strip consists of the integrally extruded elements:

a relatively rectangular rigid hollow core member, four rigid channel forming members, being two oppositely facing channel forming members extending from each side of two opposite outer surfaces of the hollow core member, the channel forming members extending from the core member being angularly directed inwardly to the center between arbitrary parallel extending lines which are tangent to the outer opposite surfaces of the core member from which the channel forming members extend, each channel forming member further including on the inward facing surface thereof:

at least one semi-rounded protrusion longitudinally extending adjacent the core member; and means for providing a gasket air seal with respect to a pane.

19. The insulating window of claim 17 further including:

(A) a plurality of separate and adjacent glazing panels, said panels being held at an edge thereof adjacent the plane surface surrounding the perimeter of the prime window in a channel of the said perimeter panel holding strip, and at least one edge of one glazing panel is held adjacent the edge of another glazing panel, and (B) at least one jointer strip having two separate oppositely facing channels, at least one of which is hingingly openable, the jointer strip joining adjacent glazing panels by holding the edges of the adjacent panels in the opposite channels of the jointer strip.

20. The insulating window of claim 18 in which the large prime window consists of an array of separate windows divided by internal framing members and in which a segmented insulating window is provided in which separate glazing panels of the insulating window correspond to each separate window in the array of prime windows and the separate glazing panels are joined by a jointer strip at a location corresponding to the location of the internal framing members of the prime window array, said jointer strip having oppositely facing channels which receive the edges of adjacent glazing panels of the insulating window.

21. The insulating window of claim 20 in which the jointer strip is attached to the internal framing member of the prime window array and includes at least one releaseably interlockable channel to receive the edge of a glazing panel.

22. The insulating window of claim 21 including two adjacent oppositely facing releaseably interlockable channels.

23. The insulating window of claim 21 including a hinged channel.

24. In extruded plastic panel holding strips adapted to be attached to the plane surface of the perimeter surrounding a wall opening, said strips having a base member and a releaseably interlockable upper member, the improved one piece extruded plastic hinged panel holding strip including a protruding right angle mounting member for attachment of the perimeter strip to the inside surface of a frame perpendicularly extending with respect to the plane surface of the prime window, said strip consisting of:

(A) a flat rigid base member adapted to be attached adjacent and to the perimeter of the plane surface surrounding the opening, said flat rigid base member including:

(1) a rigid perpendicularly extending reinforcing back disposed from one side of the width of the base member to form a rigid reinforcing corner therewith; and (2) means for releaseably interlocking with an upper member, said means for releaseably interlocking with an upper member intrinsically extending from the base member in the same direction as the back longitudinally in the portion of the width of the base member between the inside of the corner formed by the back and the base member and the opposite edge of the width of the base member;

(B) a hinge element, said hinge element being intrinsically extruded with the back extending from the base member, said hinge element, hingingly connecting the rigid back of the base member to the rigid back of a releaseably interlockable rigid upper member to which said hinge element is also intrinsically extruded; and (C) a rigid upper member, the upper member being substantially co-extensive in width with the base member and including:

(1) a rigid perpendicularly extending reinforcing back disposed from one side of the width of the upper member to form a rigid reinforcing corner therewith, said back portion intrinsically connecting to the hinge element; and (2) means for releaseably interlocking with the base member, said means for releaseably interlocking intrinsically extending from the upper member in the same direction as the back of the upper member, and longitudinally extending in the portion of the width of the upper member between the inside of the corner formed with the back and the opposite edge of the width of the upper member;

whereby, when the upper member is interlocked with the base member, a channel adapted to receive the edge of a panel is formed between the upper member and the base member in the portion of said members between the interlocked means for interlocking and the extending widths of the members; and (D) an additional flat rigid member for attachment of the perimeter strip to the interior surface of the frame perpendicularly extending with respect to the plane surface of the prime window, said additional flat rigid member intrinsically extending perpenditularly from the base member in a direction opposite the extending direction of the perpendicularly extending back, and further including therein means for fastening such additional member to the frame.

25. The panel holding strip of claim 24 in which the additional rigid member and the perpendicularly extending back are linearly aligned and form the shape of a bar crossing a "T" with respect to the base member at the junction of the said members.

26. The panel holding strip of claim 1 or 2 or 3 or 24 including a double faced insulating adhesive tape attached to the rigid member of the strip which is adapted to be attached to the surface of the frame surrounding the prime window.

* * * * *